US007799207B2

(12) United States Patent
Allinson et al.

(10) Patent No.: US 7,799,207 B2
(45) Date of Patent: Sep. 21, 2010

(54) PROCESS FOR PRODUCING TAILORED SYNTHETIC CRUDE OIL THAT OPTIMIZE CRUDE SLATES IN TARGET REFINERIES

(75) Inventors: Paul A. Allinson, Danville, CA (US); Curtis Munson, Oakland, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 1024 days.

(21) Appl. No.: 11/373,589

(22) Filed: Mar. 10, 2006

(65) Prior Publication Data

US 2007/0209967 A1 Sep. 13, 2007

(51) Int. Cl.
*C10G 45/00* (2006.01)
*C10G 65/00* (2006.01)

(52) U.S. Cl. ..... 208/58; 208/57; 208/108; 208/215; 364/149; 364/150; 364/151; 364/578; 502/219; 502/220; 502/221

(58) Field of Classification Search ..... 208/57, 208/58, 108, 215; 364/149, 578, 150, 151; 502/219, 220, 221
See application file for complete search history.

(56) References Cited

U.S. PATENT DOCUMENTS 3,369,992 A 2/1968 Henke et al.
4,454,023 A 6/1984 Lutz
4,710,486 A * 12/1987 Lopez et al. ..... 502/219
5,164,075 A * 11/1992 Lopez ..... 208/215
5,233,109 A 8/1993 Chow
5,292,989 A 3/1994 Davis
5,310,479 A * 5/1994 Audeh ..... 208/219
5,484,755 A 1/1996 Lopez
5,841,678 A * 11/1998 Hasenberg et al. ..... 703/10
5,856,260 A 1/1999 Mauldin
5,856,261 A 1/1999 Culross et al.
5,863,856 A 1/1999 Mauldin
5,945,459 A 8/1999 Mauldin
5,968,991 A 10/1999 Mauldin
6,016,868 A 1/2000 Gregoli et al.
2004/0164001 A1 8/2004 Rhodey

OTHER PUBLICATIONS

U.S. Appl. No. 10/938,269, filed Sep. 10, 2004, entitled "Process for Upgrading Heavy Oil Using Highly Active Slurry Catalyst Composition".
U.S. Appl. No. 10/938,202, filed Sep. 10, 2004, entitled "Highly Active Slurry Catalyst Composition".

(Continued)

*Primary Examiner*—Glenn Caldarola
*Assistant Examiner*—Prem C. Singh
(74) *Attorney, Agent, or Firm*—Alan Klaassen

(57) ABSTRACT

The instant invention is directed to a process wherein a heavy oil feedstock upgrader alters its mode of operation of its full conversion hydroprocessing unit to create a custom tailored synthetic crude feedstock based upon data communicated from a target refinery and data communicated from the heavy oil feedstock upgrader. The data from the target refinery is data that represents refining process data and linear program modeling along with analysis by a refining planner to calculate the optimum "synthetic trim crude" that will optimize the effective use of the target refinery's capacity and equipment.

21 Claims, 3 Drawing Sheets

OTHER PUBLICATIONS

U.S. Appl. No. 10/938,003, filed Sep. 10, 2004, entitled "Highly Active Slurry Catalyst Composition".
U.S. Appl. No. 10/938,438, filed Sep. 10, 2004, entitled "Process for Recycling an Active Slurry Catalsyst Composition in Heavy Oil Upgrading".
U.S. Appl. No. 10/938,200, filed Sep. 10, 2004, entitled "Process for Upgrading Heavy Oil Using a Highly Active Slurry Catalsyt Composition".
U.S. Appl. No. 11/303,425, filed Dec. 16, 2005, entitled "Intergrated Heavy Oil Upgrading Process and In-Line Hydrofinishing Process".
U.S. Appl. No. 11/303,426, filed Dec. 16, 2005, entitled "Process for Upgrading Heavy Oil Using a Highly Active Slurry Catalyst Composition".
U.S. Appl. No. 11/303,427, filed Dec. 16, 2005, entitled "Process for Upgrading Heavy Oil Using a Reactor With a Novel Separation System".
U.S. Appl. No. 11/303,359, filed Dec. 16, 2005, entitled Reactor for Use in Upgrading Heavy Oil Admixed With a Highly Catalyst Composition in a Slurry.
U.S. Appl. No. 11/305,377, filed Dec. 16, 2005, entitled "Process for Upgrading Heavy Oil Using a Highly Active Slurry Catalyst Composition".
U.S. Appl. No. 11/305,378, filed Dec. 16, 2005, entitled "Intergrated In-Line Pretreatment and Heavy Oil Upgrading".

* cited by examiner

PROCESS FOR PRODUCING TAILORED SYNTHETIC CRUDE OIL THAT OPTIMIZE CRUDE SLATES IN TARGET REFINERIES

FIELD OF THE INVENTION

The present invention relates to a continuous or batch process wherein a heavy oil feedstock upgrader produces a synthetic crude oil which is custom tailored to fill out a refinery's crude slate.

BACKGROUND OF THE INVENTION

Global energy usage continues to rise with no sign of abatement, creating a growing demand for oil resources. Light, sweet crude oil production is not increasing enough to meet this growing demand. Additionally, the reserves of light, sweet crude oil are being depleted more rapidly than new reserves are being found. To fill this gap, larger quantities of heavy oil feedstocks such as heavy crude oils or extra heavy crude oils derived from various carbonaceous resources are being brought on stream. The cost of development of these heavy crude oil resources has been decreasing over the last several decades making them more economical to recover.

Heavy crudes often require some processing to reduce their viscosity and to make them pumpable. Several processes which may be used for this purpose include partial upgrading by hydroprocessing, by coking or by blending the heavy crude with light hydrocarbons. Additives may also be used. Another alternative for handling heavy crude is to form an oil-in-water emulsion, optionally with the addition of additives to reduce the crude's viscosity. All of these processes create a pumpable generic type syncrude suitable for refinery processing. However, the economics of processing these pumpable generic type syncrudes are prohibitively expensive, because of the low conversion rates of the heavy crude oil resources.

U.S. Pat. No. 3,369,992 discloses a distillate low pour point synthetic crude oil produced from a virgin distillate and a reduced crude from a high wax content and high pour point crude. This synthetic crude is formed by mixing the virgin distillate with a fraction obtained by coking the reduced crude. The coker overhead volatile product is fractionated into a heavy stream for recycle to the coker and a distillate fraction which is recovered as a low pour point synthetic crude.

U.S. Pat. No. 4,454,023 discloses a process, including visbreaking, distillation, and solvent extraction for rendering a heavy viscous crude pumpable.

U.S. Pat. No. 5,233,109 discloses a synthetic crude produced by catalytically cracking a biomass material comprising a plant oil and/or an animal oil and/or a rubber material.

U.S. Pat. No. 6,016,868 discloses an integrated process for treating production fluids to form a synthetic crude oil. The production fluids are recovered from the application of in situ hydrovisbreaking of heavy crudes and natural bitumen deposited in subsurface formations.

U.S. Patent Application Publication 2004/0164001 A1 discloses a business process that monetizes bitumen reserves utilizing proven refining processes to ultimately produce high quality refined oil products.

Additional disclosures relating to the preparation of a syncrude are taught in U.S. Pat. Nos. 5,968,991; 5,945,459; 5,856,261; 5,856,260; 5,863,856 and 5,292,989.

While some processes have been proposed to reduce the viscosity of a crude, none have been offered for producing a synthetic crude which is tailored for the current needs of a particular refinery. Furthermore, no process has been described for producing a synthetic crude which comprises vacuum gas oil or lighter fractions.

SUMMARY OF THE INVENTION

The present invention is directed to a process for preparing a syncrude. The present invention is also directed to a process for tailoring a syncrude such that it has optimum properties with respect to the requirements for producing fuels and/or lubricant base oils in a particular refinery. The present invention is also directed to a process which upgrades a heavy crude oil to produce a multiplicity of syncrudes, each tailored for one of a multiplicity of refineries.

The feedstock to the process is a heavy oil feedstock. The synthetic crude (alternatively "syncrude") which is made in the present process is a partially upgraded crude feedstock, having a lower sulfur content and a lower metals content than the heavy oil feedstock from which it is made. In a further embodiment, the syncrude is more easily processed in a conventional refinery than the heavy oil feedstock from which it is made. In a further embodiment, the syncrude boils within a range of temperatures which is lower than the boiling range of the heavy oil feedstock from which it is made.

At least in part, the present invention is based on the realization that there is a particular crude or range of crudes with properties which are ideal for a particular refinery. Thus, a target refinery identifies the properties of a tailored feedstock which, when processed in the refinery, meets select targets for overall operation and the distribution and quality of the product slate. Conventionally, a refinery must process a number of crudes, some of which may have widely differing properties. Though each refinery tries to select crudes which best meet its particular requirements, making such a selection often has undesirable cost implications. At best, the refinery will attempt to purchase a crude slate that meets some of its requirements.

In contrast, the product of the present process is a tailored synthetic crude, with properties which are tailored to meet the requirements of a particular target refinery. The crude is further a synthetic crude, produced by upgrading a heavy oil feedstock. The upgrading conditions used in the upgrading step to produce the tailored crude is selected on the basis of a refining data set from the target refinery that characterizes the tailored synthetic crude and of a feedstock data set that characterizes a heavy oil feedstock.

Accordingly, the present invention provides an integrated integrated process for upgrading a heavy oil feedstock, the process comprising: (a) establishing a communication link between an upgrading facility and a target refinery; (b) acquiring a refining data set from the target refinery that characterizes a tailored synthetic crude; (c) generating an upgrading data set from the upgrading facility that characterizes a heavy oil feedstock; (d) using the refining data set from the target refinery and the upgrading data set from the upgrading facility to generate a dataset of select upgrading process conditions; (e) hydroprocessing the a heavy oil feedstock, at the select upgrading process conditions, within the upgrading facility and recovering a tailored synthetic crude; and (f) transporting the tailored synthetic crude to the target refinery.

In one embodiment, the upgrading step is a hydroprocessing step, comprising contacting the heavy oil feedstock with hydrogen in the presence of an unsupported slurry catalyst. In a further embodiment, the unsupported slurry catalyst comprises molybdenum sulfide. In yet a further embodiment, the unsupported slurry catalyst is prepared by: (a) mixing a Group VI B metal oxide and aqueous ammonia to form a Group VI metal compound aqueous mixture; (b) sulfiding, in an first reaction zone, the aqueous mixture with a gas comprising hydrogen sulfide to a dosage greater than 8 SCF of hydrogen sulfide per pound of Group VIB metal to form a slurry; (c) promoting the slurry with a Group VIII metal; (d) mixing the promoted slurry with a first hydrocarbon oil having a viscosity of at least 2 cSt at 212° F. to form a reaction mixture; (e) combining the reaction mixture with hydrogen gas and a second hydrocarbon oil in a second reaction zone to form an active catalyst composition, the second hydrocarbon oil having a boiling point in the range from 50° F. to 300° F. and further having a lower viscosity than the first hydrocarbon oil. This embodiment is further described in U.S. Ser. Nos. 10/938,202, 10/938,269, 10/938,003, 10/938,438, 10/938,200 which are incorporated by reference.

DETAILED DESCRIPTION OF THE INVENTION

Figure 1:
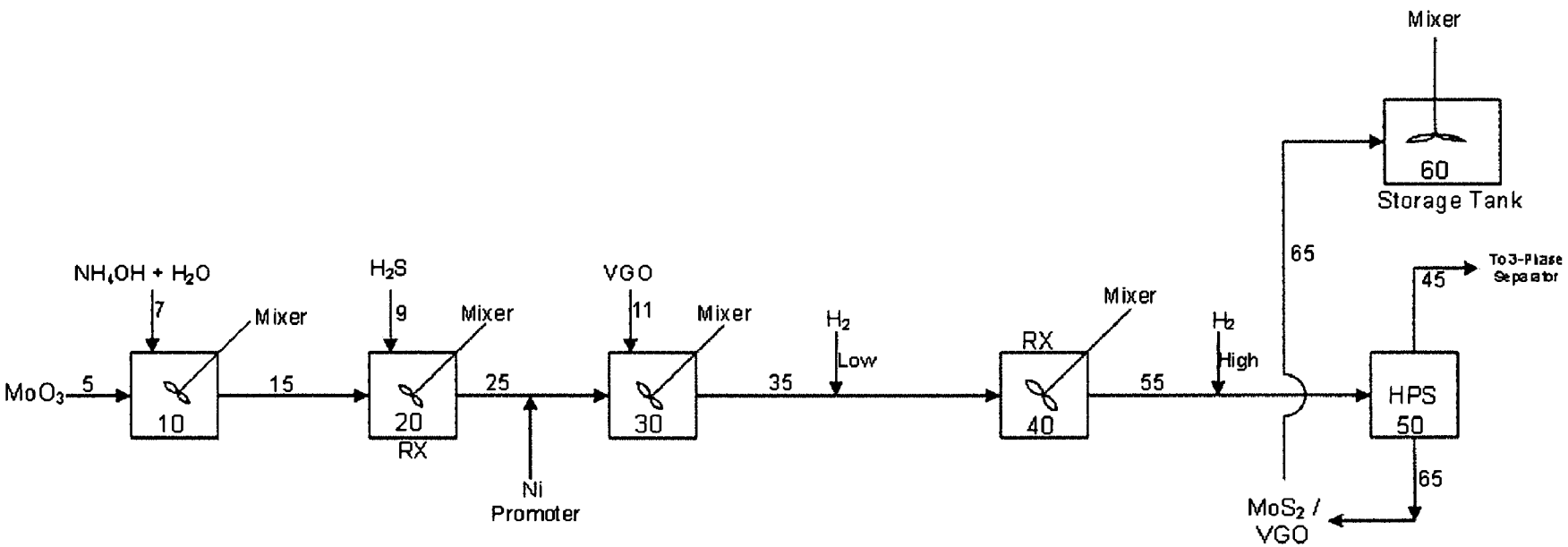
FIG. 1 illustrates the preparation of an unsupported slurry catalyst.

This invention is directed to a process wherein a heavy oil feedstock upgrader creates a custom tailored synthetic crude feedstock based upon data communicated from a target refinery and data gathered from the heavy oil feedstock upgrader. The data from the target refinery represents refining process data and linear program modeling along with analysis by a refining planner to calculate the optimum "synthetic trim crude" that will improve, and ideally optimize, the effective use of the target refinery's capacity and equipment. Economic information, including a "willing-to-pay" price is calculated for a specified volume of tailored synthetic crude. This information is then communicated to the heavy oil feedstock upgrader. The heavy oil feedstock upgrader will use the refining data plus the data that characterizes the heavy oil feedstock resource to model and analyze all the data sets. The resulting analysis informs the heavy oil feedstock planner the appropriate upgrading operating conditions needed to produce the tailored crude for the target refinery. The process will further allow a heavy oil feedstock upgrader to supply each of multiple refineries with an individual optimized tailored syncrude that meets the current crude feedstock needs for that refinery.

Heavy Oil Feedstock

In embodiments of the invention, the heavy oil feedstock may be a raw stock such as a crude that is upgraded according to the present process. The feedstock may be hydroprocessed prior to upgrading or it may be treated to remove contaminants, e.g. salts and water, prior to upgrading. The feedstock may be a residuum fraction from distillation. It may be one or more products from a separation process, or it may be the product of a pyrolysis or liquefaction process. It may be the product from a size reduction process, e.g. grinding, or it may the product from a prior processing step.

The heavy oil feedstock which is the feed to the process is a carbonaceous oil derived from at least one of the following sources: tar sands; bitumen; coal; lignite; peat; oil shale; crude oils; synthetic oils such as from a Fischer-Tropsch process; recycled oil wastes and polymers; and residuum bottom process stream oils. Typically, the heavy oil feedstock has a API gravity that ranges from 12 to less than 0, a viscosity greater than 5000 cp at 100° F., and with significantly high concentrations of nitrogen, sulfur, metal contaminants, and asphaltenes. Furthermore, the heavy oil feedstock has a 95 percent normal boiling point, as determined by ASTM D1160 of greater than 1000° F. Heavy oil feedstocks with at least 50 volume percent boiling above 1000° F. and even at least 75 volume percent boiling above 1000° F. can be processed as described herein. Indeed, a heavy oil feedstock which is a vacuum residuum, with greater than 95 volume percent boiling above 1000° F., can be processed as described herein to produce the synthetic crude. The sulfur content of the feedstock will be generally above 2 percent; a feedstock containing greater than 4 percent sulfur and even greater than 6 percent sulfur can be processed as described herein. Likewise, the nitrogen content of the feedstock to the process will be above 0.3 percent; a feedstock containing greater than 0.5 percent nitrogen and even greater than 1 percent nitrogen can also be processed as described herein. Likewise, the feedstock can contain more than 25 wppm of metal contaminants such as nickel and/or vanadium; a feedstock containing greater than 50 wppm metal contaminants and even greater than 100 wppm metal contaminants can be processed as described herein. It is a feature of the upgrading process that extra heavy crudes containing very large amounts of sulfur, nitrogen and metals can be processed in a single step to produce light and clean syncrudes that require a minimum of further upgrading in the production of desired fuel, lubricants and chemical feedstocks. Boiling point properties are used herein are normal boiling point temperatures, based on ASTM D1160.

Communication Link

The process of the invention includes use of a communication link between the target refinery and the upgrading facility. The communication link is any means whereby information can be passed between the target refinery and the upgrading facility. Examples of communication means which are suitable for the present process include the analog or digital communication means, including, for example, telephone, fax, wireless device, cellular, intranet, internet, microwave, satellite, radio, computer, or any other typical mode of communication to communicate date or other types of information. Communications between the target refinery and the upgrading facility may involve more than one type of communication link. Likewise, communications between multiple refineries with a single upgrading facility may involve more than one type of communication link, with individual refineries possibly using different communication means from each other.

Upgrading Process

In one embodiment, the upgrading process comprises either a carbon rejection process such as fluid coking, hydrocoking, or Flexicoking; or a hydrogen addition process such as hydrocracking, hydrotreating, hydrodewaxing, hydrofinishing, hydrodesulphurization, hydrodenitrification, hydrodemetallization, etc. The upgrading process may further include other process steps to further enhance the properties of the custom tailored synthetic crude. These units can include but are not limited to an atmospheric distillation units, vacuum distillation units, reformer units, separators, and fractionators.

In another embodiment, the upgrading process comprises contacting the heavy oil feedstock with hydrogen in the presence of a catalyst for removing contaminants from the heavy oil feedstock and for reducing the boiling point range of the heavy oil feedstock. The effectiveness of the upgrading process may be indicated by the degree of conversion. For purposes of this disclosure, conversion is reported as the ratio of the amount by volume of 1000° F.+ material in the upgrading product, divided by the amount by volume of 1000° F.+ material in the upgrading process feed, wherein the ratio is subtracted from 1. Conversion is reported here in terms of volume percent.

CASH Catalyst

The highly active unsupported molybdenum sulfide based catalyst is an unsupported slurry catalyst composition that can achieve 100 percent conversion of the heavy oil feedstock feed. A catalyst composition which is useful for the present process is disclosed, for example, in U.S. patent application Ser. No. 10/938,202 filed Sep. 10, 2004 and U.S. patent application Ser. No. 10/938,003 filed Sep. 10, 2004, both of which are incorporated herein by reference for all purposes. U.S. patent application Ser. No. 10/938,202 teaches a catalyst composition prepared by a series of steps, involving mixing a Group VIB metal oxide and aqueous ammonia to form an aqueous mixture, and sulfiding the mixture to form a slurry. The slurry is then promoted with a Group VIII metal. Subsequent steps involve mixing the slurry with a hydrocarbon oil and combining the resulting mixture with hydrogen gas and a second hydrocarbon oil having a lower viscosity than the first oil. An active catalyst composition is thereby formed. A catalyst composition which also may be useful for the present invention is disclosed in U.S. patent application Ser. No. 10/938,003. This application discloses a slurry catalyst composition prepared in a series of steps, involving mixing a Group VIB metal oxide and aqueous ammonia to form an aqueous mixture and sulfiding the mixture to form a slurry. The slurry is then promoted with a Group VIII metal. Subsequent steps involve mixing the slurry with a hydrocarbon oil, and combining the resulting mixture with hydrogen gas (under conditions which maintain the water in a liquid phase) to produce the active slurry catalyst.

In one embodiment, the upgrading process comprises contacting the heavy oil feedstock with hydrogen in the presence of an unsupported slurry catalyst. The unsupported slurry catalyst is prepared by a process comprising: (a) mixing a Group VIB metal oxide and aqueous ammonia to form a Group VI metal compound aqueous mixture; (b) sulfiding, in an initial reactor, the aqueous mixture of step (a) with a gas comprising hydrogen sulfide to a dosage greater than 8 SCF (0.23 cubic meters) of hydrogen sulfide per pound of Group VIB metal to form a slurry; (c) promoting the slurry with a Group VIII metal compound; (d) mixing the slurry of step (c) with hydrocarbon oil having a viscosity of at least 2 cSt at 212° F. (100° C.) to form a mixed slurry; (e) combining the mixed slurry with hydrogen gas in a second reaction zone, under conditions which maintain the water in the mixed slurry in a liquid phase, thereby forming an active catalyst composition admixed with a liquid hydrocarbon; and (f) recovering the active catalyst composition. As used herein, the abbreviation SCF is used to represent "standard cubic feet", referenced to a temperature of 60° F. (16° C.) and 1 atmosphere total pressure.

The preparation of the unsupported slurry catalyst is illustrated in FIG. 1. The active slurry catalyst composition is prepared by mixing line 5, containing an oxide of Group VIB metal such as tungsten or molybdenum, and line 7, containing aqueous ammonia, in a mixing zone 10. The temperature of the mixing zone is generally in the range from about 80° F. to about 200° F., preferably from about 100° F. to about 150° F., and most preferably from about 110° F. to about 120° F. The pressure of the mixing zone 10 is generally from about atmospheric pressure to about 100 psig, preferably from about 5 psig to about 35 psig, and most preferably from about 10 psig to about 35 psig. The Group VIB metal oxide is dissolved in water containing the ammonia. The amount of ammonia added is based on the ratio of NH3 to Group VIB oxide in lbs/lbs and generally ranges from 0.1 lbs/lbs to about 1.0 lbs/lbs, preferably from about 0.15 lbs/lbs to about 0.50 lbs/lbs, and most preferably from about 0.2 lbs/lbs to about 0.30 lbs/lbs. The dissolved metal oxide in aqueous ammonia is moved via line 15 to the first reaction zone.

The amount of hydrogen sulfide (line 9) added to the reaction zone 20 is based on the ratio of H2S to Group VIB metal oxide in SCF/lbs and generally ranges from 4.0 SCF/lbs to about 20 SCF/lbs, preferably from about 8.0 SCF/lbs to about 18 SCF/lbs, and most preferably from about 12 to 14 SCF/lbs. The reaction time in the first reaction zone ranges from about 1 hour to 10 hours, preferably from 3 hours to 8 hours, and most preferably from about 4 hours to 6 hour per pound of Group VIB metal oxide. Conditions include a temperature in the range from 80° F. to 200° F., preferably in the range from 100° F. to 180° F., and most preferably in the range from 130° F. to 160° F. Pressure is in the range from 100 to 3000 psig, preferably in the range from 200 to 1000 psig, and most preferably from 300 to 500 psig. The resultant slurry is the catalyst precursor in an aqueous slurry phase.

The resultant slurry is combined with a Group VIII metal compound such as Ni or Co, as disclosed in U.S. Pat. No. 5,484,755. As an enhancement of the denitrogenation activity of the active slurry catalyst of the present invention, it is preferred that a Group VIII metal compound be added to the slurry before mixing the slurry with feed oil and a hydrogen containing gas at elevated temperature and pressure. Such Group VIII metals are exemplified by nickel and cobalt. It is preferred that the weight ratio of nickel or cobalt to molybdenum range from about 1:100 to about 1:2. It is most preferred that the weight ratio of nickel to molybdenum range from about 1:25 to 1:10, i.e., promoter/molybdenum of 4-10 weight percent. The Group VIII metal, exemplified by nickel, is normally added in the form of the sulfate, and preferably added to the slurry after sulfiding at a pH of about 10 or below and preferably at a pH of about 8 or below. Group VIII metal nitrates, carbonates or other compounds may also be used. In view of the high activity of the slurry catalyst of the present invention, the further promotion by Group VIII metal compounds is very advantageous.

The slurry containing the Group VIII metal promoter is moved, via line 25, to mixing zone 30. Mixing zone 30 employs an inert atmosphere which can comprise nitrogen, refinery gas, or any other gas having little or no oxygen. The slurry and a hydrocarbon oil (line 11), such as VGO, are mixed continuously in a high shear mode, forming a mixed slurry, to maintain a homogeneous slurry in mixer 30. High shear mixing encompasses a range from 100 to 1600 RPM. Preferably the mixing rate is greater than 500 RPM and most preferably greater than 1500 RPM.

The hydrocarbon oil has a kinetic viscosity of at least 2 cSt (32.8 SSU) @ 212° F. The kinetic viscosity can generally range from about 2 cSt (32.8 SSU) @ 212° F. to about 15 cSt (77.9 SSU) @ 212° F., preferably from about 4 cSt (39.5 SSU) @ 212° F. to about 10 cSt (59.2 SSU) @ 212° F., and most preferably from about 5 cSt (42.7 SSU) @ 212° F. to about 8 cSt (52.4 SSU) @ 212° F. The hydrocarbon oil causes the initial transformation of the catalyst precursor to an oil base from a water base. The ratio of Group VIB metal oxide to oil is at least less than 1.0, preferably less than 0.5, and more preferably less than 0.1. If the kinetic viscosity of the oil is below about 2 cSt (32.8 SSU) @ 212° F. or above about 15 cSt (77.9 SSU) @ 212° F., the first transformation of the catalyst precursor will result in catalyst particles agglomerating or otherwise not mixing.

The mixed slurry from mixing zone 30 moves to reaction zone 40 via line 35. Hydrogen is continuously added to the mixture reaction zone 40, and high shear mixing is employed in the reaction zone 40 in order to maintain a homogenous slurry. Hydrogen is added at low pressure prior to reactor 40 and at high pressure following reactor 40. This is done in order to keep water in liquid phase in reactor 40, change water to vapor phase after reactor 40 in order to flash off the water. When the low H2 rate is used in reactor 40, water is still in liquid phase. Following reactor 40, more H2 is added, so the water changes to vapor phase, permitting separation from oil slurry in high pressure separator. The process conditions of reactor 40 are critical to forming the final catalyst. The water in the mixture must be maintained in a liquid phase.

The temperature of the reaction zone 40 generally ranges from about 300° F. to 600° F., preferably from about 350° F. to about 500° F., and most preferably from about 350° F. to about 450° F. The pressure of the reaction zone 40 generally ranges from about 100 psig to about 3000 psig, preferably from about 200 psig to about 1000 psig, and most preferably from about 300 psig to about 500 psig. The hydrogen flow to the reaction zone 40 generally ranges from about 300 SCFB to about 2000 SCFB, preferably from about 300 SCFB to about 1000 SCFB, and most preferably from about 300 SCFB to about 500 SCFB. The reaction time in the reaction zone 40 ranges from about 10 minutes to 5 hours, preferably from 30 minutes to 3 hours, and most preferably from about 1 hour to 1.5 hours. The resultant slurry mixture is the active catalyst composition in admixture with the hydrocarbon oil.

The slurry mixture is passed, through line 55, to high pressure separator 50. More hydrogen is added in line 55 so the water changes to vapor phase. It can then be separated from oil slurry in the high pressure separator 50. The high pressure separator operates in a range from 300° F. to 700° F. Gases and water are removed overhead through line 45 and passed to a three phase separator. The unsupported slurry catalyst is moved through line 65 to storage tank 60. The unsupported slurry catalyst is continuously mixed in storage tank 60 to maintain a homogenous slurry in a hydrogen atmosphere with little or no oxygen. In this way, the catalyst activity and stability are maintained.

The unsupported slurry catalyst may be used for upgrading heavy oil feedstock. Following preparation of the unsupported slurry catalyst, the upgrading process comprises: (a) combining, in an upgrading reactor under hydroprocessing conditions, heavy feed, hydrogen gas, fresh catalyst slurry composition, and recycle slurry composition; (b) passing the effluent of the upgrading reactor to a separation zone wherein products boiling at temperatures up to 900° F. are passed overhead; (c) passing the material remaining in the separation zone from step (b) to a constantly stirred catalyst storage tank; and (d) passing at least a portion of the material in the constantly stirred catalyst storage tank back to the upgrading reactor of step (a).

Figure 2:
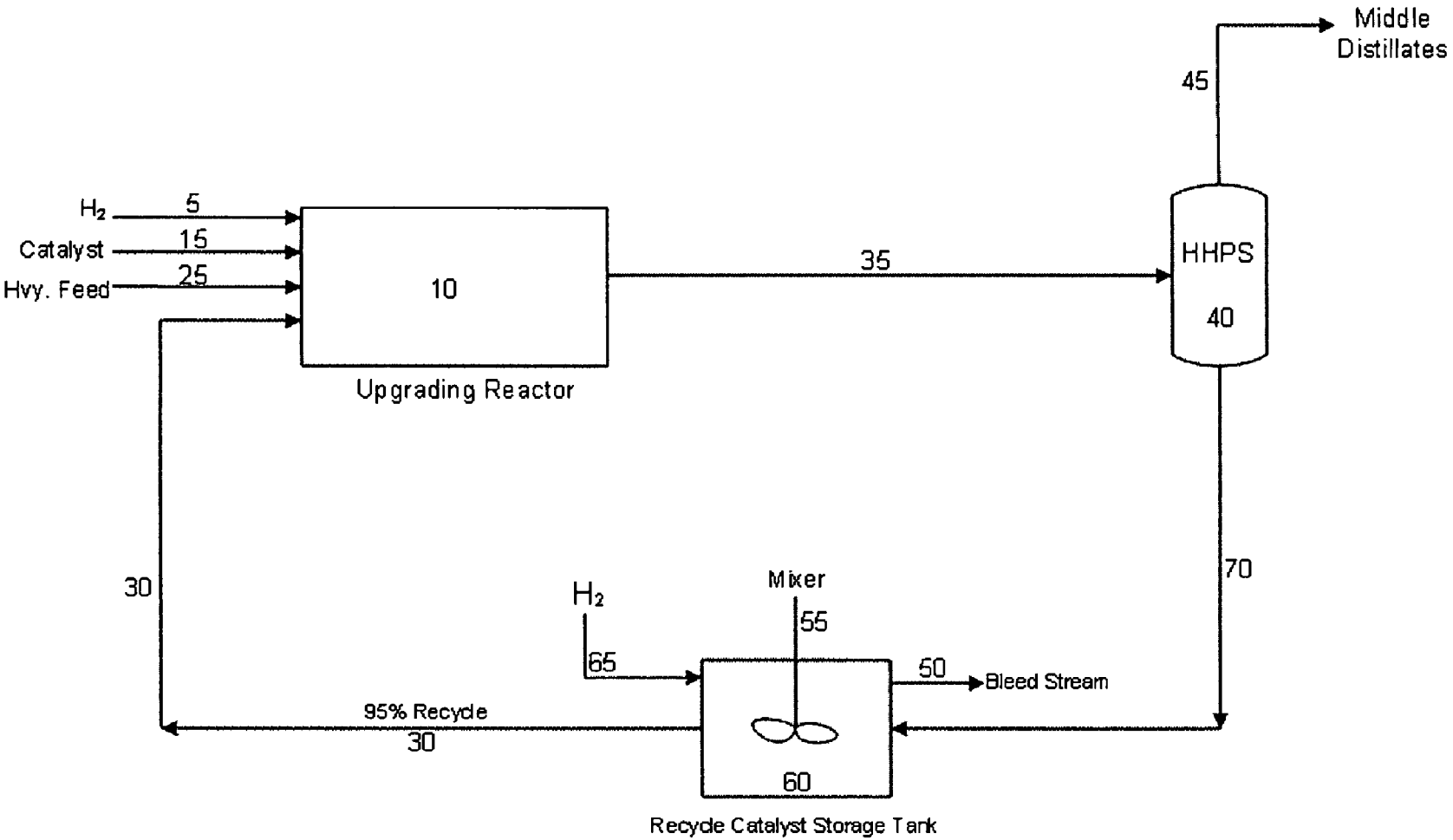
FIG. 2 illustrates upgrading employing the unsupported slurry catalyst.

Reference is now made to FIG. 2, which illustrates an embodiment of the upgrading process. Other embodiments of the upgrading process are disclosed in U.S. Ser. Nos. 11/305,377, 11/305,378, 11/305,359, 11/303,425, 11/303,426, and 11/303,427, which are incorporated herein by reference. The process of the present invention can be operated in either a single, or in multiple, stage modes. A single stage upgrading reactor 10 is shown in FIG. 2. An optional second stage (not shown) may be, for example, an integrated hydrotreater. In the process shown in FIG. 2, the heavy oil feedstock 25 is contacted with the unsupported slurry catalyst and a hydrogen-containing gas (line 5) at elevated temperatures and pressures in one or more continuously stirred tank reactors or ebullated bed catalytic reactors. The unsupported slurry catalyst is composed of up to 95 wt percent recycle material (line 30) and 5 wt percent fresh catalyst (line 15). The feed, catalyst slurry and hydrogen-containing gas are mixed in upgrading reactor 10 at a residence time and temperature sufficient to achieve measurable cracking rates.

The effluent from the upgrading reactor 10 passes through line 35 to the hot high pressure separator 40. The resultant light oil (45) is separated from solid catalyst and unconverted heavy oil (70) in the hot high pressure separator 40, and passes through line 45 to middle distillate storage. Alternately, the light oil may be sent to the second-stage reactor (not shown). This reactor is typically a fixed bed reactor used for hydrotreating of oil to further remove sulfur and nitrogen, and to improve product qualities. The product (45) is free of catalyst and does not require settling, filtration, centrifugation, etc.

In the hot high pressure separator 40, substantially all of the upgraded products generated from the upgrading zone 10 goes overhead as gas-vapor stream 45. The liquid in the bottom of the hot high pressure separator 40, composed primarily of unconverted oil and active catalyst, is passed through line 70 to the recycle catalyst storage tank 60. This tank is constantly stirred, using mixer 55, and a constant reducing atmosphere is maintained by the addition of hydrogen (line 65). Excess hydrogen may be removed by bleed stream 50. The catalyst slurry is recycled back to upgrading reactor 10 as needed through line 30. Up to as much as 95 wt percent of the catalyst used in the upgrading reactor is recycled in this way.

In a preferred embodiment, the upgrading process is operated at up to 100 percent conversion, based on a target temperature of 1000° F. These extremely high conversion levels are possible by maintaining a reducing atmosphere throughout the upgrading, separation and storage steps, and not allowing the catalyst composition to settle at any time. In one embodiment, the reducing atmosphere is controlled by maintaining the catalyst in a hydrogen-rich atmosphere at all times.

In another embodiment, separation in the hot high pressure separator is the only separation needed to separate the catalyst from the product oil. The product oil is purified and cracked sufficiently that it can be used directly for distillation into fuel and lubricant base oil cuts, with only minor further processing being required before sale or transportation to a target refinery. Throughout the process, substantial temperature and pressure fluctuations are tolerated with only minor precipitate formation of supercondensates and coke. Further, the catalyst can be maintained and recycled numerous times with minimal fouling and deactivation.

For the first-stage operation as depicted in upgrading reactor 10, the reaction temperatures for heavy oil feedstocks are normally above about 700° F., preferably above 750° F., and most preferably above 800° F. in order to achieve high conversion. Maximum temperatures are in the range of 900° F. Hydrogen partial pressures range from 350 to 4500 psi and hydrogen to oil ratio is from 500 to 10,000 SCFB. The concentration of the active slurry catalyst in the heavy oil is normally from about 100 to 20,000 ppm expressed as weight of metal (molybdenum) to weight of heavy oil feedstock. Typically, higher catalyst to oil ratio will give higher conversion for sulfur, nitrogen and metal removal, as well as the higher cracking conversion. The high pressure separator temperature can be as high as 800° F. Near 100 percent demetalation conversion and 1000° F.+ cracking conversion of the heavy oil can be achieved at appropriate process conditions, while the coke yield can be maintained at less than about 1 percent.

The process conditions for the second-stage (not shown in FIG. 2) are typical of heavy oil hydrotreating conditions. The second-stage reactor may be either a fixed, ebullated or a moving bed reactor. The catalyst used in the second-stage reactor is a hydrotreating catalyst such as those containing a Group VIB and/or a Group VIII metal deposited on a refractory metal oxide. By using this integrated hydrotreating process, the sulfur and nitrogen content in the product oil can be very low, and the product oil qualities are also improved.

In the present invention, product 45 from the upgrading process is a syncrude having the properties selected by a target refinery for which the tailored syncrude is prepared. It is a feature of the invention that the upgrading process, as described herein, is sufficiently flexible to be able to quickly adjust process conditions, and thus to make a first syncrude which is tailored for a first target refinery, and, immediately afterwards, a second syncrude which is tailored for a second target refinery (or in response to a request for a different syncrude from the first target refinery. In this way, a single upgrading process, located at a convenient location with respect to the hydrocarbon resource and all of the refineries which it serves, can provide multiple syncrudes, each tailored for the current needs of particular individual refinery.

Refining DataSet

In the process of this invention, a target refinery specifies properties of a tailored syncrude for use in the refinery. The desired properties may be as simple as specifying, for example, the boiling range, the sulfur content or the metals content of the syncrude. In most cases, a number of properties may be specified, such as, for example, one or more of physical properties (including density, viscosity, color); contaminant content (including sulfur, nitrogen, oxygen, metals, water); distillation properties (including the full distillation curve by ASTM D1160, mid-boiling point, end boiling point, initial boiling point, flash point); hydrocarbon components (including paraffins, cycloparaffins, aromatics, asphaltenes, microcarbon residue) and the like.

The methods which are used for specifying the properties of a tailored syncrude are not critical for the invention. Modern refineries are well equipped to determine the desired properties of a feed to the refinery, using market information, customer requirements, cost structures of products, expert intelligence, as well at knowledge of the refinery, including modeling data, process data, planning data, and analysis input data. Any or all of these may be employed to best define the properties of a desired tailored syncrude.

Feedstock Dataset

A feedstock dataset characterizes the heavy oil feedstock which is upgraded in the present process. This dataset will generally include specific values for various physical, chemical and compositional properties of the feedstock, which are supplied to the upgrading dataset for determining upgrading process conditions needed to produce the desired syncrude. Example properties which may be specified include one or more of physical properties (including density, viscosity, color); contaminant content (including sulfur, nitrogen, oxygen, metals, water); distillation properties (including the full distillation curve by ASTM D1160, mid-boiling point, end boiling point, initial boiling point, flash point); hydrocarbon components (including paraffins, cycloparaffins, aromatics, asphaltenes, microcarbon residue); and the like.

Upgrading Dataset

An upgrading dataset characterizes the performance of the upgrading process. Typically, the dataset is developed from the feedstock dataset and the refining dataset, using an understanding of the upgrading process itself. Such understanding may derive from one or more of the following: technical expert analysis, mathematical and/or computer models, historical data, experimental data, current operating data, analytical data and the like. For the purposes of the present invention, these methods are used for comparing the quality of the heavy oil feedstock, via the feedstock dataset, with the requirements of the target refinery, using the refining dataset, to develop a set of upgrading operating conditions for producing a tailored syncrude which meets the requirements of the target refinery. The set of operating conditions and instructions which develop from this comparison is termed the upgrading dataset. It is expected that the dataset may include specifications to at least one of reaction temperature, heavy oil feedstock rate, hydrogen rate, catalyst circulation rate, reaction pressure, reactor size, number of reactor modules, product separation parameters such as cutpoint, number of individual fractions recovered, characterization of at least one of the fractions recovered, additional product upgrading steps, such additional hydrotreating, hydrocracking and/or isomerization and the like.

Tailored Synthetic Crude

The tailored synthetic crude (or "syncrude") is provided to the target refinery for further refining. The properties of the syncrude have been tailored to match the communicated requirements of the target refinery. In one embodiment, the upgrading process is effective to converting high amounts of extra heavy crude oils to useful products in a single step of hydroprocessing. It is normally the high amounts of sulfur, metals, asphaltenes and otherwise refractory residua molecules which refineries prefer to be much reduced in the tailored syncrude. Thus, a typical tailored syncrude of the present process will generally have a 95 percent boiling point (by ASTM D1160) of less than 1200° F., preferably of less than 1100° F., and more preferably of less than 1000° F. As used herein, boiling points which are reported for liquid materials are referenced to a pressure of 1 atmosphere, unless stated otherwise. Likewise, the tailored syncrude will typically contain less than 4 percent by weight sulfur, more preferably less than 2 percent by weight sulfur and still more preferably in the range of 0.2 to 2.0 percent by weight sulfur. Likewise, the tailored syncrude will typically contain less than 100 ppm total metal contaminants, preferably less than 75 ppm total metal contaminants, and more preferably less than 30 ppm total metal contaminants. Likewise, the ° API Gravity of the tailored syncrude will typically be greater than 5, preferably greater than 10 and more preferably in the range of 20 to 45. It will be recognized by the skilled practitioner that a single tailored syncrude may meet only one (or less than the total) of these compositional and property limits. This is expected, since each target refinery will have varying needs which may further vary from time to time through the year.

Target Refinery

The target refinery is the recipient of the tailored syncrude. As will be clear to the skilled practitioner, any remote processing system for the tailored syncrude would constitute a target refinery. Thus, the refinery, as contemplated here, may range in scale and complexity from the 250,000 bbl/day range with a complex processing scheme and literally hundreds of individual products, to a marketer who fractionates the tailored syncrude and distributes the individual fractions to customers for use as fuels and lubricants, or as feedstocks to further processing.

The synthetic crude which is prepared as described herein may be tailored such that minimal additional processing is required. An inherent advantage thereof is that much of the tailored synthetic crude can be converted to useful fuel and lubricant products, with a minimal production of less valuable by-products. Example fuels which may be prepared in the target refinery include naphtha, gasoline, jet fuel, kerosene, diesel fuel, wherein the boiling ranges of these products are defined by or derived from the standard specifications. Likewise, example lubricant base oils may be produced by from the tailored synthetic crude. In one embodiment, the process of the invention provides a tailored synthetic crude, such that wherein at least 75 percent by volume, preferably at least 90 percent by volume, and more preferably at least 95 percent by volume of the tailored synthetic crude which is transported to the target refinery is converted to liquid fuel products in the target refinery.

Transportation

The tailored synthetic crude will be transported by a transportation means, including by, for example, railroad, truck, ship, pipeline, or airplane in containers that include tanks, vessels, and containerized units. In one embodiment, the tailored synthetic crude will be modified, if needed, to permit transportation using conventional means for moving petroleum stocks. Thus, a tailored synthetic crude may be fractionated prior to being transported, in order to reduce a potential vapor pressure hazard. Such processes are well known, and do not require additional details.

Figure 3:
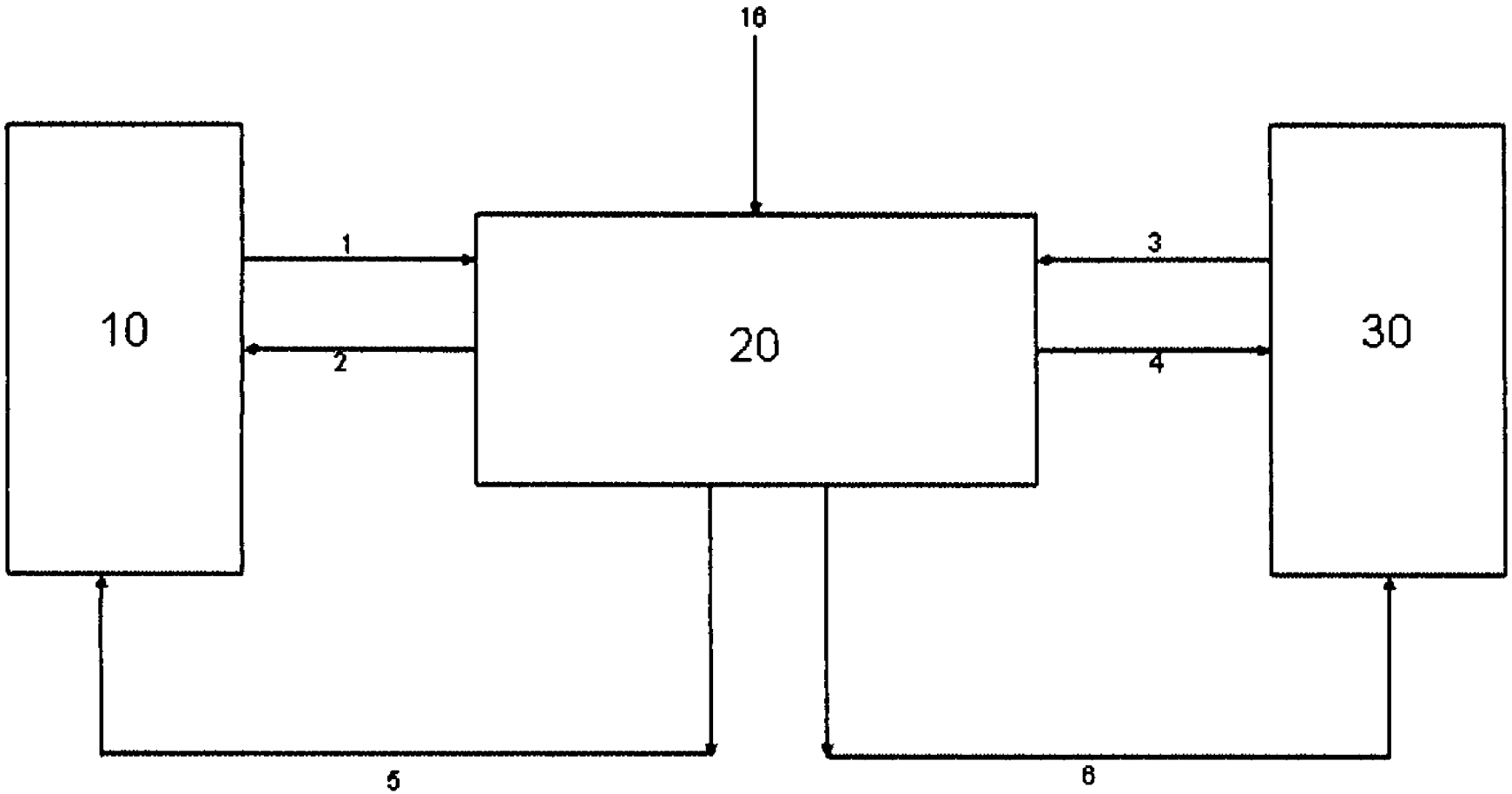
FIG. 3 illustrates an heavy crude oil upgrading facility producing two distinct custom tailored syncrudes for two target refineries, each communicating their own optimum "synthetic trim crude" requirements and "willing-to-pay" price.

FIG. 3 illustrates the production of two different custom tailored synthetic crudes for two target refineries having different "synthetic trim crude" needs produced from one heavy oil feedstock upgrading facility. A first target refinery (10) communicates its requirements (1) of a desired "synthetic trim crude" to the heavy oil feedstock upgrading facility (20). The heavy oil feedstock upgrading facility (20) uses these requirements and the data that represents the heavy oil feedstock feed source (16) to set upgrading process conditions needed to produce the tailored synthetic crude for target refinery (10). Information (2) is communicated from upgrading facility (20) to target refinery (10) and upon agreement of pricing, quantity, and delivery times, first tailored synthetic crude (5) is produced and delivered to target refinery (10).

Likewise, a second target refinery (30) communicates its requirements (3) of a desired second "synthetic trim crude" to the heavy oil feedstock upgrading facility (20). The heavy oil feedstock upgrading facility (20) uses these requirements and the data that represents the heavy oil feedstock feed source (16) to set upgrading process conditions needed to produce the tailored synthetic crude for target refinery (30). Information (4) is communicated from upgrading facility (20) to target refinery (30) and upon agreement of pricing, quantity, and delivery times, second tailored synthetic crude (6) is produced and delivered to target refinery (30). It should be noted that the upgrading facility (20) will either process both first and second tailored synthetic crudes in a batch sequence mode where one tailored synthetic crude (5) is produced and the order is completed followed by the other tailored synthetic crude (6). Alternatively, the upgrading facility (20) could have enough capacity or more than one upgrading unit to run both first tailored synthetic crude (5) and second tailored synthetic crude (6) in tandem in a continuous process mode. The overall scheme is essentially identical if more than 2 tailored crudes are desired and prepared.

Other benefits of this process include custom tailored synthetic crudes that exhibit properties and fraction cuts that are a typical (and rarely if ever appear) in native oils. This type of tailored synthetic crude is created by altering operating parameters and the various upgrader conversion units. By selectively biasing the creation of one or more fractions, tailored synthetic crude can be produced that matches the available capacity of a refinery and thus relieve the refinery of having to purchase intermediate streams. For example, tailored synthetic crude could be produced that is rich in gas oils, which would allow a target refinery that typically imports VGO to eliminate that purchase. This option would not be available when filling out crude slates based on traditional crude oil because lighter and heavier components are naturally present in those crudes.

Additional benefits from this process include reduction in waste such as coke and sulfur. The final tailored synthetic crude will be more hydrogenated, thus lowering the hydrogen requirements at the target refinery. The target refinery will have less waste produced due to the lower sulfur, nitrogen, and metal concentration in the custom tailored synthetic crude. The target refinery will not have to produce low value product streams such as gas oils and asphaltic road mix. The target refinery will have increased catalyst life in their reactor systems due to a much cleaner tailored synthetic crude source.

EXAMPLE

Example

Refinery planners at company downstream locations run weekly linear program models to optimize the refinery's crude slate, operation, and utilization, nominally 20 weeks in advance of the actual processing date. The base crude slate is chosen, and the linear program model is run again substituting the tailored synthetic crude for all or some of the base crude slate. The willing-to-pay-price and optimum volume are calculated. For example Refinery "A" may specify a 30 days supply of 100 MBPD 28.6 API syncrude with 10 percent bottoms, 80 percent middle distillates and gas oil, and 10 percent naphtha at $32.12 per bbl. This information would be communicated to the planner at Upgrader "1". Simultaneously, Refinery "B" may specify a need for similar 30 days supply of 60 MBPD 36 API bottomless Synthetic Precision Crude Oil at $37.16 per bbl, and again the information is communicated to Upgrader "1" planner. Upgrader "1" is capable of producing a nominal 200 MBPD, and would run for 15 days to produce the 3 MM bbls of tailored synthetic crude for Refinery "A" and then switch to production for Refinery "B" and would run for 9 days to produce the 1.8 MM bbls required.

What is claimed is:

1. An integrated process for upgrading a heavy oil feedstock, comprising:

a) establishing a communication link between an upgrading facility and a target refinery;

b) acquiring a refining data set from the target refinery that characterizes a tailored synthetic crude having a 95% boiling point as determined by ASTM D1160 of less than 1000° F. and API gravity of greater than 10;

c) generating a feedstock data set from the upgrading facility that characterizes a heavy oil feedstock having a 95% boiling point as determined by ASTM D1160 of greater than 1000° F.;

d) using the refining data set from the target refinery and the feedstock data set from the upgrading facility to generate an upgrading dataset of select upgrading process conditions;

e) upgrading the heavy oil feedstock at the select upgrading process conditions within the upgrading facility and recovering a tailored synthetic crude, wherein the upgrading comprises contacting the heavy oil feedstock with hydrogen in the presence of an active unsupported slurry catalyst wherein the active unsupported slurry catalyst in oil is a catalyst composition prepared by:

a) mixing a Group VI B metal oxide and aqueous ammonia to form a Group VI metal compound aqueous mixture;

b) sulfiding, in a first reaction zone, the aqueous mixture with a gas comprising hydrogen sulfide to a dosage greater than 8 SCF of hydrogen sulfide per pound of Group VIB metal to form a slurry;

c) promoting the slurry with a Group VIII metal;

d) mixing the promoted slurry with a first hydrocarbon oil having a viscosity of at least 2 cSt at 212° F. to form a reaction mixture;

e) combining the reaction mixture with hydrogen gas and a second hydrocarbon oil in a second reaction zone to form an active catalyst composition, the second hydrocarbon oil having a boiling point in the range from 50° F. to 300° F. and further having a lower viscosity than the first hydrocarbon oil; and f) transporting the tailored synthetic crude to the target refinery.

2. The integrated process according to claim 1, wherein the heavy oil feedstock has a 50 percent boiling point of greater than 1000° F.

3. The integrated process according to claim 2, wherein the heavy oil feedstock has a 10 percent boiling point of greater than 1000° F.

4. The integrated process according to claim 1, wherein the step (e) of upgrading the heavy oil feedstock comprises hydrotreating the heavy oil feedstock at conditions sufficient to reduce the sulfur content and the 95 percent boiling point of the heavy oil feedstock, to produce the tailored synthetic crude.

5. The integrated process according to claim 4, wherein the tailored synthetic crude has a sulfur content of less than 2 percent by weight.

6. The integrated process according to claim 5, wherein the tailored synthetic crude has a sulfur content in the range of 0.2 to 2.0 percent by weight.

7. The integrated process according to claim 1, wherein the active unsupported slurry catalyst in oil comprises molybdenum sulfide.

8. The integrated process according to claim 1, wherein the heavy oil feedstock is processed in the presence of from about 100 ppm to about 20,000 ppm of the unsupported slurry catalyst, expressed as weight of molybdenum metal to weight of heavy oil feedstock.

9. The integrated process according to claim 1 wherein the heavy oil feedstock is derived from at least one of the following sources: tar sands and bitumen; coal, lignite, peat and oil shale; crude oil; topped crude oil; synthetic oils such as from a Fischer-Tropsch process; recycled oil wastes and polymers; and residuum bottom process stream oils.

10. The integrated process according to claim 1, wherein the communication link between the upgrading facility and the target refinery is selected from the group consisting of telephone, fax, cellular, intranet, internet, microwave, satellite, radio, computer.

11. The integrated process according to claim 1, wherein the refining dataset comprises modeling data, process data, planning data, and analysis input data.

12. The integrated process according to claim 1 step (c), wherein the upgrading dataset comprises modeling data, process data, planning data, and analysis input data.

13. The integrated process according to claim 1, wherein the heavy oil feedstock is treated prior to the upgrading of step (e).

14. The integrated process according to claim 13, wherein the treating step prior to upgrading comprises at least one of fluid coking, Flexicoking, hydrocracking, hydrotreating, hydrofinishing, hydrodesulphurization, hydrodenitrification, or hydrodewaxing.

15. The integrated process according to claim 1, wherein the tailored synthetic crude is transported using at least one of railway, truck, ship, pipeline or airline transportation.

16. The integrated process according to claim 1, wherein the tailored synthetic crude is converted to at least one liquid fuel product in the target refinery.

17. The integrated process according to claim 16, wherein at least 75 percent of the tailored synthetic crude which is transported to the target refinery is converted to liquid fuel products in the target refinery.

18. The integrated process according to claim 17, wherein at least 90 percent of the tailored synthetic crude, which is transported to the target refinery, is converted to liquid fuel products in the target refinery.

19. The integrated process according to claim 18, wherein the liquid fuel product is selected from the group consisting of gasoline, jet fuel and diesel fuel.

20. The integrated process according to claim 1, wherein the step of upgrading comprises:

a) combining, the heavy oil feedstock, hydrogen gas, the active unsupported slurry catalyst admixed in a hydrocarbon oil, and a recycle slurry composition, in an upgrading reactor under hydroprocessing conditions;

b) passing the effluent of the upgrading reactor to a separation zone and recovering an overhead product and a bottoms product, wherein the overhead product comprises material boiling at temperatures up to 900° F.;

c) passing the bottoms product to a constantly stirred catalyst storage tank; and d) passing at least a portion of the material in the constantly stirred catalyst storage tank back to the upgrading reactor of step (a).

21. The integrated process according to claim 1, wherein the upgrading dataset of select upgrading process conditions include at least one of: reaction temperature, heavy oil feedstock rate, hydrogen rate, catalyst circulation rate, reaction pressure, reactor size, number of reactor modules, product separation parameters such as cutpoint, number of individual fractions recovered, characterization of at least one of the fractions recovered, and additional product upgrading steps.

* * * * *